US007661559B1

(12) United States Patent
Tresenfeld

(10) Patent No.: US 7,661,559 B1
(45) Date of Patent: Feb. 16, 2010

(54) TUBE HOLDER

(76) Inventor: Eugene Lee Tresenfeld, 523 Antelope Way, Eugene, OR (US) 97401

( * ) Notice: Subject to any disclaimer, the term of this patent is extended or adjusted under 35 U.S.C. 154(b) by 627 days.

(21) Appl. No.: 11/238,951

(22) Filed: Sep. 28, 2005

(51) Int. Cl.
*B65D 35/28* (2006.01)

(52) U.S. Cl. ..... 222/94; 222/93; 222/95; 222/106; 248/109; 211/85; 312/209; 132/314

(58) Field of Classification Search ..... 222/93–95, 222/101, 102, 106; 132/314, 315; 248/108, 248/109; 211/85; 206/369; 312/107, 108, 312/117–119, 122, 209, 245, 246, 309, 310
See application file for complete search history.

(56) References Cited

U.S. PATENT DOCUMENTS 2,812,880 A * 11/1957 Altman ..... 222/94
3,194,621 A * 7/1965 Frost ..... 312/206
3,698,404 A * 10/1972 Greco ..... 132/315
3,851,938 A * 12/1974 McCowan et al. ..... 312/117
5,466,058 A * 11/1995 Chan ..... 312/111
5,975,362 A * 11/1999 West ..... 222/102
6,896,154 B1 * 5/2005 Lomeli ..... 222/102
2006/0071020 A1 * 4/2006 Wiesner et al. ..... 222/95

* cited by examiner

*Primary Examiner*—J. Casimer Jacyna
(74) *Attorney, Agent, or Firm*—Risto A. Rinne, Jr.

(57) ABSTRACT

An apparatus for securing squeezable tubes therein includes a plurality of vertical compartments that are each adapted to hold one squeezable tube. A plurality of moveable front members are adapted to move up or down between an opposite pair of sidewalls to retain an upper portion of the tube in position. An open top allows easy tube insertion or removal while a lower shelf retains the bottom of each tube. A bottom strip ensures that each tube will remain in position. According to a first modification, the interior sidewalls are adjustable to accommodate a variable spacing between them. Modified moveable front members include a variable width to accommodate the variable spacing between the adjustable interior sidewalls. According to a second modification, each tube is retained by a pair of curved side members that narrow toward the bottom of each compartment. An apparatus to secure a tube in an inverted position and to dispense a substance from a bottom opening is described.

14 Claims, 3 Drawing Sheets

TUBE HOLDER

BACKGROUND OF THE INVENTION

1. Field of the Invention

The present invention, in general, relates to squeezable tubes and, more particularly, to a tube holder for squeezable tubes.

Toothpaste tubes, ointments, glues, oil and acrylic artist paint, and a variety of other lotions and substances come in squeezable tubes. Some of these tubes get smaller as the material is dispensed whereas other tubes retain their overall size and shape as the material is being dispensed from within. Often, these tubes are placed on shelves in medicine cabinets where they take up considerable shelf space. Similarly, they are placed on any available flat surface or counter top, even on top of toilet tanks and, depending on the content, in other work areas, etc.

In general, squeezable tubes are unsightly when left scattered about, and there is not available an effective special storage device to properly secure them, ready for use.

One reason for this is because they are constantly changing their shape, that is, they constantly become shorter as they are used and the ends are rolled up. However, for some people, they do not necessarily become shorter because the ends are squeezed but not rolled up. Consequently, they become thinner.

Another reason for this is because squeezable tubes come in a variety of sizes. There is no known adjustable device to effectively hold squeezable tubes.

Also, it is desirable to store certain types of squeezable tubes in an inverted position with the top down so that the contents tend to migrate toward the open end, ready for immediate dispensing.

Again, some people may wish to store their tubes upright. In either case, there is a need to quickly remove the tube from the holder when it is needed and to quickly deposit the tube in the tube holder after use.

There is sometimes a need to store squeezable tubes out of sight, for example in a medicine cabinet, or behind a cabinet door. There is also a need to store squeezable tubes on a visible flat surface, for example, a wall.

Also, there typically are a number of squeezable tubes that must be stored, each having a potentially unique size that is constantly varying.

Additionally, for certain squeezable tubes, like toothpaste, it is desirable to provide a solution that permits easy and rapid dispensing of the toothpaste onto a toothbrush.

Accordingly, there exists today a need for a tube holder that helps to ameliorate the above-mentioned difficulties.

Clearly, such an apparatus would be a useful and desirable device.

2. Description of Prior Art

Tube holders and racks are, in general, known. For example, the following patents describe various types of these devices:

U.S. Pat. No. Des. 171,595 to Harriton, Mar. 2, 1954;

U.S. Pat. No. Des. 206,254 to Lopiano, Nov. 15, 1966;

U.S. Pat. No. Des. 256,411 to Neuman, Aug. 19, 1980;

U.S. Pat. No. 1,833,608 to Gunnison, Nov. 24, 1931; and

U.S. Pat. No. 2,190,567 to Jung, Feb. 13, 1940.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a tube holder that is adapted to store a squeezable tube in an upright position.

It is also an important object of the invention to provide a tube holder that is adapted to store a squeezable tube in an inverted position.

Another object of the invention is to provide a tube holder that is adapted for use with different sizes of squeezable tubes.

Still another object of the invention is to provide a tube holder that is adapted to secure a plurality of squeezable tubes.

Still yet another object of the invention is to provide a tube holder that is attachable to a flat surface.

Yet another important object of the invention is to provide a tube holder that is adapted for use in a medicine cabinet or on an inside of a cabinet door.

Still yet another important object of the invention is to provide a tube holder that is adapted for use on a wall.

A first continuing object of the invention is to provide a tube holder that allows quick removal of a tube from the tube holder for use and quick and easy insertion of the tube back into the tube holder after use.

A second continuing object of the invention is to provide a tube holder that allows removal of a portion of the contents of a squeezable tube from the tube while the tube remains in the tube holder.

A third continuing object of the invention is to provide a tube holder that allows for a tiered arrangement with one row of tubes disposed over another row.

A fourth continuing object of the invention is to provide a tube holder that secures a tube in an inverted position with a bottom cap removed and which is adapted to dispense a quantity of a substance from the tube when a compressive force is applied to the tube.

A fifth continuing object of the invention is to provide a tube holder that is able to allow for removal of a portion of the contents of a squeezable tube from a type of tube that changes its size or shape or both its size and shape as the contents are being dispensed and to retain the tube in the tube holder.

A sixth continuing object of the invention is to provide a tube holder that is able to allow for removal of a portion of the contents of a squeezable tube from a type of tube that does not change its size or shape or both as the contents are being dispensed and to retain the tube in the tube holder.

Briefly, a tube holder that is constructed in accordance with the principles of the present invention has a plurality of vertical compartments that are each adapted to hold one squeezable tube, either in an upright or in an inverted position. According to a first embodiment, a plurality of moveable front members are adapted to move up or down between an opposite pair of sidewalls to retain an upper portion of the tube in position as the tube is consumed and its overall length decreases or to accommodate different length tubes. An open top allows easy insertion or removal while a lower shelf retains the bottom of each tube. A bottom strip ensures that the tube will remain in position. According to a first modified embodiment, the interior sidewalls are adjustable to accommodate a variable spacing between them. Modified moveable front members fit in opposite slots and include a variable width to accommodate the variable spacing between the adjustable interior sidewalls. An attachment secures, for example, a tube of toothpaste in an inverted position for ready dispensing. A roller engages with the slots and dispenses toothpaste when it is urged downward. According to a second modified embodiment, each tube is retained by a pair of curved side members that extend from a sidewall and fold around toward the front of the tube to secure it therein. Different spacing between the curved side members accommodate different overall sized tubes while a narrowing of a space between the curved side members at the bottom of each compartment prevents each tube from passing through the compartment and through an open bottom.

DETAILED DESCRIPTION OF THE INVENTION

Figure 1:
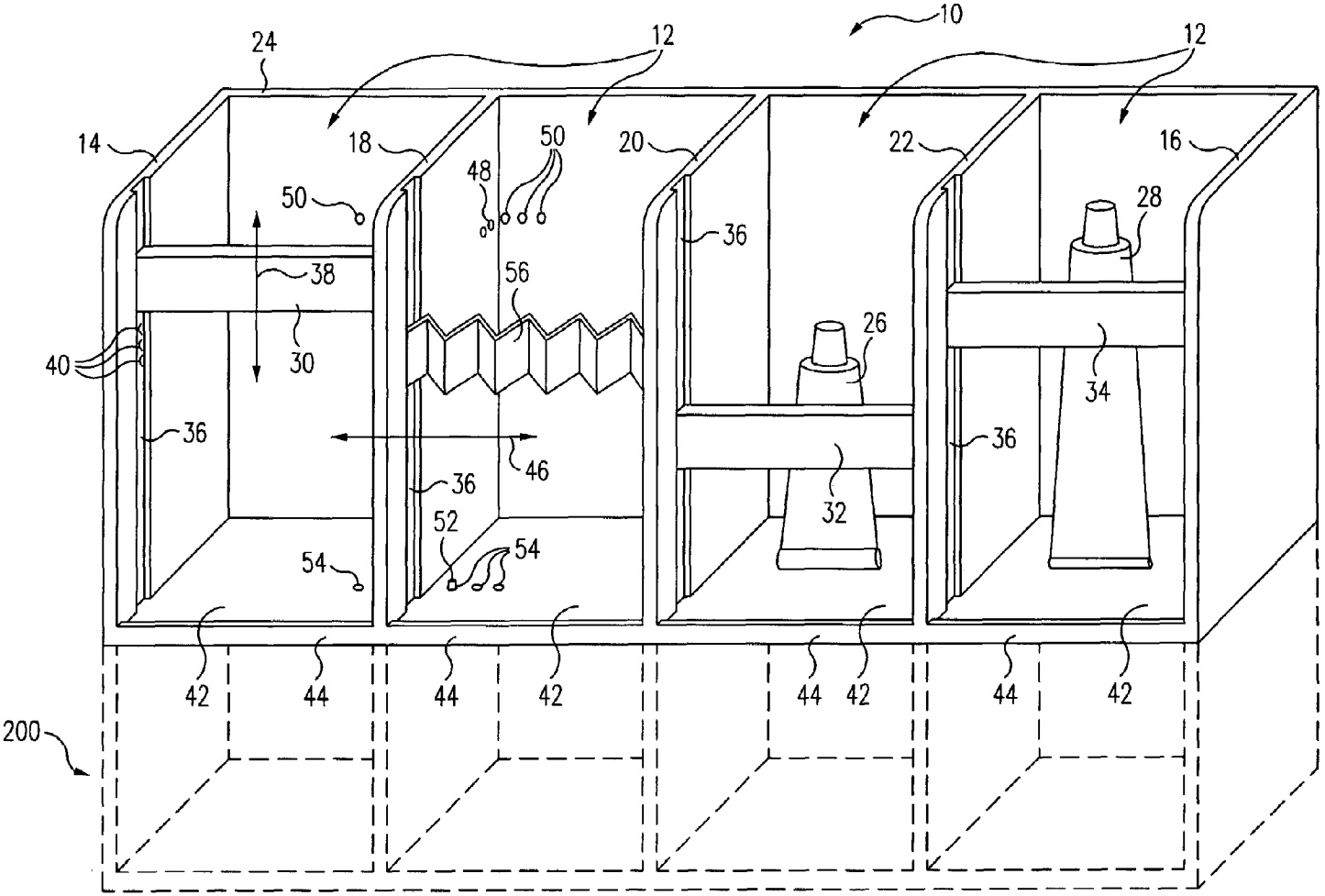
FIG. 1 is view in perspective of a tube holder with a modification thereto also shown.

Referring to FIG. 1 is shown, a tube holder, identified in general by the reference numeral 10.

A plurality of vertical compartments, identified in general by the reference numeral 12, are provided with any desired spacing between a first outer sidewall 14, a second outer sidewall 16 and a plurality of interior sidewalls 18-22.

A planar rear member 24 is adapted for placement against a flat planar surface, for example, against the back of a medicine cabinet door (not shown) or the back of a cabinet door (not shown) or directly on a visible flat surface such as a wall (not shown).

The rear member 24 is attached by screws (not shown) that pass through mounting holes provided in the rear member 24 or alternatively by an adhesive or double-stick tape that is disposed on the back of the rear member 24.

Each compartment 12 is adapted to hold one squeezable tube 26, 28, either in an upright or an inverted position.

In general, most tubes 26, 28 range from about 1 and ½ inches in width to about 3 and 1/16 inches in width. Of course, other sizes are possible.

When a fixed spacing between the parallel first and second outer sidewalls 14, 16 and the interior sidewalls 18, 20, 22 is included with the tube holder, the fixed spacing can be the same for each compartment 12, or it can vary as desired.

For example, a preferable fixed spacing may include different width compartments 12, one of each having a width of 2 and ¼ inches, 2 and ½ inches, 2 and ¾ inches, and 3 and ¼ inches. Of course, any other spacing is also possible depending upon the intended application. Similarly, any number of compartments 12 may be included with one compartment 12, of course, being the minimum.

If the tubes 26, 28 contain substances that may vary in width, then the compartment 12 widths are varied to suite the intended application. If the tubes 26, 28 are generally all the same width, for example, as found with artist's paints, then the compartments 12 will likely all be the same width, the width being selected to optimally accommodate the width of the tubes 26,28. The number of compartments 12 that are included as well as the height of the sidewalls 14-22 are similarly varied as desired.

A plurality of fixed-width moveable front members 30, 32, 34 are each adapted to move up or down between an opposite pair of slots 36 that are provided on the sidewalls 14-22 in each compartment 12, as shown by arrow 38. Each front member 30-34 is urged up or down to accommodate the length of the tube 26, 28.

Assuming the tube 28 is unused and at its maximum length (i.e., height), the corresponding front member 34 is raised to provide support near the top of the tube 28. The front member 34 is not placed at the top as this tends to impede removal of the tube 28, but rather is disposed below the top sufficient to retain the tube 28 in position.

As the tube 28 is used, its length decreases as shown by tube 26. Accordingly, the length of the tube 26 decreases during use as its contents are consumed, and to compensate for a change in overall length of the tube 26, the corresponding front member 32 is lowered to provide support near the top of the now shortened tube 26.

Certain types of the tube 28 do not decrease their overall length when the contents are consumed. Rather, they compress while maintaining the same general overall length. For such applications, the front member 32 is initially adjusted for the length of the particular tube 28 and does not have to be readjusted unless a different size tube 28 is used.

This allows the tube holder 10 to accommodate any desired length or varying length of the tube 26, 28.

The front members 30, 32, 34 are each held in place within the slots 36 by friction or, alternatively, by protrusions that extend from the ends of the front members 30-34 and which cooperate with recesses 40 that are provided on opposite ends of the slots 36.

A bottom planar member 42 retains the bottom of each tube 26, 28 in place. A front bottom strip 44 extends upward from the bottom planar member 42 and helps retain the bottom of the tubes 26, 28 in position, especially when a sudden movement is applied to the tube holder 10. A sudden movement can occur if the tube holder 10 is attached to an inside of the medicine cabinet or the cabinet door, which is then suddenly opened or closed.

The open top of the tube holder 10 allows for easy withdrawal or insertion of the tube 26, 28 from the tube holder 10.

The tubes 26, 28 are placed in either an upright position (with the cap on top) or in an inverted position (with the cap on bottom), as desired.

According to a first modified embodiment, at least one adjustable interior sidewall is provided. In the drawing figure, the first interior sidewall 18 is adjustable horizontally as shown by arrow 46.

The first interior sidewall 18 includes an upper protrusion 48 that extends out of the back thereof and which is adapted to enter into one of several upper rear openings 50 that are provided in the rear member 24.

A similar lower protrusion 52 that extends out of the bottom of the first interior sidewall 18 is adapted to enter into one of several lower bottom openings 54 that are provided in the bottom planar member 42.

To adjust the width of the compartment 12 to suit the width a particular squeezable tube (not shown), a top of the first interior sidewall 18 is pulled away from the rear member 24 sufficient to remove the upper protrusion 48 from the upper rear opening 50 that it is in cooperation with.

A bottom of the first interior sidewall 18 is raised from the bottom planar member 42 sufficient to remove the lower protrusion 52 from the lower bottom opening 54 that it is in cooperation with.

This frees the first interior sidewall 18 from the tube holder 10 and allows it to be moved horizontally in either direction along the second arrow 46 until a desired spacing is obtained from the first outer sidewall 14 and the second interior sidewall 20.

When the desired spacing is attained the lower protrusion 52 is inserted into the proper lower bottom opening 54 and the upper protrusion 48 is inserted into the proper upper rear opening 50.

As many of the remaining interior sidewall members 20, 22 as desired, may also be similarly modified to move horizontally. However, it is preferable that at least one of the first and second end sidewalls 14, 16 remain fixed in position to define the left and right ends of the tube holder 10. For certain applications, both end sidewalls 14, 16 are fixed while for other applications one of them is fixed and other is adapted to be moved horizontally to provide adjustment for the width of the last compartment.

Similarly, as many upper rear openings 50 and as many lower bottom openings 54 are included as desired having whatever spacing there-between as is desired.

After benefit of the instant disclosure, there are other ways in which the first interior sidewall 18 (or any other interior sidewall 20, 22) can be adapted to move and also to be secured where desired along the second arrow 46. For example, horizontal slots could be provided (not shown) in which the interior sidewalls 20, 22 are adapted to move from side to side.

When any of the interior sidewall members 18, 20, 22 is adapted to move along the second arrow 46, a method must be provided to vary the width of the front members 30, 32, 34 to accommodate the variable distance between the interior sidewall members 18, 20, 22 and also possibly between the first and second outer sidewalls 14, 16.

A preferred solution is to use a modified moveable front member 56 that includes a variable width. A preferable type of the modified moveable front member 56 includes an accordion structure that applies a slight force which tends to urge its opposite ends apart and into the slots 36.

When the spacing intermediate any of the sidewall members 14-22 changes, the accordion structure either expands or retracts to compensate accordingly.

After having had benefit of the above disclosure, other ways to make the moveable front member of variable length sufficient to accommodate the variable distance between the interior sidewall members 18, 20, 22 are possible.

For example, a further modified moveable front member (not shown) includes two pieces that each include a slot along a longitudinal length thereof. The two slots align when the two pieces are placed atop each other and are held together by a small bolt that passes through the two slots and a nut that cooperates with the bolt. By loosening the nut while retaining the bolt within the slots, the two pieces can be moved closer together or further apart to accommodate a variable distance between the interior sidewall members 18, 20, 22 and the first and second outer sidewalls 14, 16.

The benefits provided by certain of the embodiments disclosed herein appertain for use with the tube 28 regardless of whether or not the tube 28 changes shape or size or both during a dispensing of its contents. When, during use the tube 28 changes its shape or its size or both its size and its shape, the adjustable sidewall members 18, 20, 22 or the fixed-width moveable front members 30, 32, 34 or the modified moveable front member 56 or any combination of the above are adjusted to accommodate the change in size. This provides a substantial increase in utility not previously available.

Figure 2:
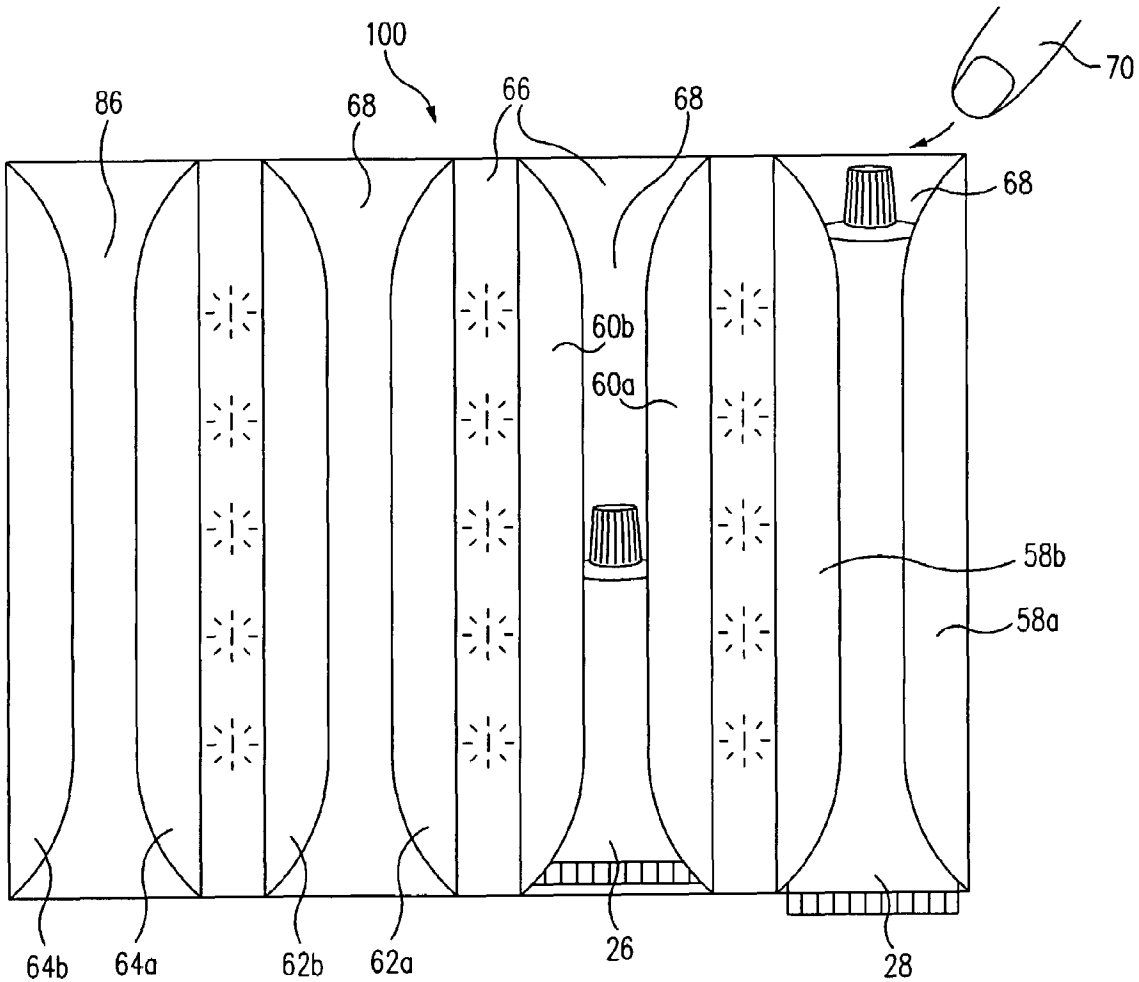
FIG. 2 is view in perspective of another modified type of tube holder.

Referring now to FIG. 2, according to a second modified tube holder 100, each tube 26, 28 is retained by a respective pair of curved side members 58*a* 58*b*, 60*a*, 60*b*, 62*a*, 62*b*, 64*a*, 64*b*.

The curved side members 58-64 extend away from a rear panel 66 and include a sidewall that extends the vertical height of the second modified tube holder 100. The curved side members 58-64 continue forward sufficient to surround each tube 26, 28 and fold around toward the front of each tube 26, 28 an amount sufficient to secure it therein.

Different spacing between each pair of the curved side members 58-64 accommodate different overall sized (i.e., width) tubes 26, 28.

The width between each respective pair of curved side members 58-64 is not constant but narrows toward the bottom of each compartment 68. As the tubes 26, 28 are generally larger at the top (near the cap), the narrowing of the space between the curved side members 58-64 at the bottom of each compartment 68 prevents each of the tubes 26, 28 from passing through the compartment 68 and through an open bottom. The tubes 26, 28 become lightly wedged in each compartment.

It is possible for a user to place a finger 70 in the gap between any pair of curved side members 58-64 and lift the tube 26, 28 to remove it from the second modified tube holder 100. To reinsert the tube 26, 28 back into the second modified tube holder 100, it is simply dropped back into the compartment 68 in which it falls until the narrowing pair of curved side members 58-64 secures it in place.

It is also possible to use the finger 70 to remove the cap while the tube 26, 28 is still in the second modified tube holder 100 by placing the finger in the gap against the cap and then urging the finger 70 to remove or attach the cap, as desired. Pressure can then be applied to the tube 26, 28 in the gap sufficient to squeeze some of the tube's 26, 28 contents out of the top without the need to remove the tube 26, 28 from the second modified tube holder 100.

Any preferred material can be used for either the tube holder 10 or the second modified tube holder 100. The second modified tube holder 100 can be further modified, as desired, to allow a variable spacing between the curved side members 58-64 in a manner similar to that described for the tube holder 10 or, alternatively, the second modified tube holder 100 can be formed out of a thin metallic stock, for example, and then bent from side to side to vary the distance there-between.

Referring again to FIG. 1, is shown a third modified tube holder 200, in dashed lines. The third modified tube holder includes a tiered structure in which one or more of the tube holders 10 or the second modified tube holders 100 are placed atop each other. This is useful to accommodate a large number of tubes 28 in a limited space, such as an artist might use.

Figure 3:
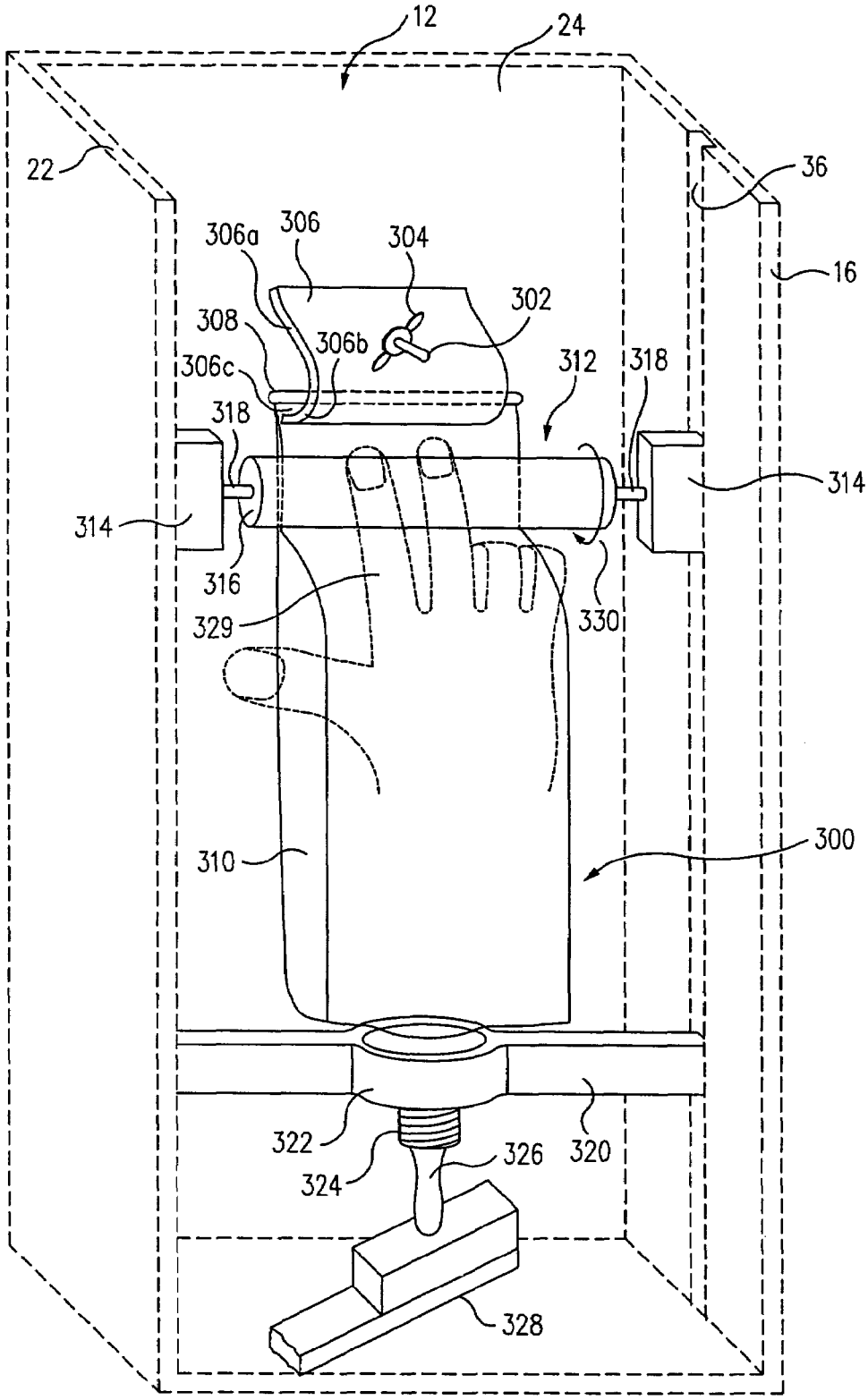
FIG. 3 is view in perspective of an accessory added to the device of FIG. 1 for dispensing toothpaste.

Referring now primarily to FIG. 3 and on occasion to FIG. 1 is shown an inverted tube dispenser, identified in general by the reference numeral 300.

The inverted tube dispenser 300 is disposed in one of the plurality of vertical compartments 12. By way of example only, the right-most compartment 12 includes the inverted tube dispenser 300 and it is shown in dashed lines so as to allow better clarity of the component parts of the inverted tube dispenser 300.

A lug bolt 302 is attached near the top of the rear member 24 and in the center of the compartment 12. A wing nut 304 cooperates with threads on the lug bolt 302 sufficient to draw an arcuate plate 306 toward the rear member 24 when the wing nut 304 is tightened.

The arcuate plate 306 includes a generally flat portion 306*a* through which a hole is provided for the lug bolt 302 to pass. The arcuate plate 306 includes a radius portion 306*b* that extends from the flat portion 306*a* and includes a bottom edge 306*c*. The bottom edge 306*c* includes a width that is nearly that of a conventional type of a tube of toothpaste 310 or any other preferred tube.

To use the inverted tube dispenser 300 the wing nut is loosened and removed so that a bottom of the arcuate plate 306 can be pulled away from the rear member 24 and to permit a roller assembly 312, as is described in greater detail below, to be urged into position. Then, a bottom lip 308 of the conventional type of a tube of toothpaste 310 is urged between a bottom edge of the arcuate plate 306 and the rear member 24.

The roller assembly 312 includes a pair of side rails 314 that engage with the slots 36 on one side of each side rail 314. The roller assembly 312 includes a roller 316 that includes an axle 318 passing through its longitudinal center. The axle 318 is attached to an opening provided in an opposite side of each of the side rails 314. The axle 318 and the roller 316 are able to freely rotate about the center longitudinal axis.

Prior to attachment of the tube of toothpaste 310, it is squeezed near the bottom lip 308, as needed, to urge an interior quantity of toothpaste (not shown) away from the bottom lip 308 sufficient to flatten the tube of toothpaste 310 near the lip 308.

The entire roller assembly 312 is then urged down as required in the slots 36 until it is disposed over the flattened area proximate the bottom lip 308.

The arcuate plate 306 is then placed in position and the wing nut 304 is tightened which draws the bottom edge 306*c* of the arcuate plate 306 tight against the tube of toothpaste 310, just below the bottom lip 308. Accordingly, the tube of toothpaste 310 is suspended in an inverted position in the compartment 12 with the roller assembly 312 disposed adjacent to the radius portion 306*b* of the arcuate plate 306.

The tube of toothpaste 310 is retained in this position and cannot move downward within the compartment 12.

A lower member 320 includes an enlarged center opening 322 that includes a large enough diameter to accommodate a threaded neck 324 of the tube of toothpaste 310, after a cap (not shown) has first been removed.

The lower member 320 extends into the slots 36 and can also slide up or down. After the tube of toothpaste 310 has been secured in position, the cap is removed and then the lower member 320 is urged upward until the center opening 322 is over the threaded neck 324. This retains the threaded neck 324 in position. The lower member 320 is provided in a variety of sizes to accommodate variations in cap and neck sizes that occur with various types of tubes. It is possible to provide a modified lower member (not shown) that adjusts in size as desired. It is also possible to omit the lower member 320, if desired.

To dispense a quantity of toothpaste 326 onto a toothbrush 328, the toothbrush 328 is held under the threaded neck 324 while at least one finger 329 of an opposite hand (shown in dashed lines) is placed on the roller 316. The finger 329 then applies a downward force to the roller 316, as shown by arrow 330, sufficient to rotate the roller 316 about its longitudinal axis and to urge the roller 316 and the roller assembly 312 downward.

The diameter of the roller 316 is large enough so as to flatten the tube 310 between the circumference of the roller 316 and the rear member 24 an amount sufficient to apply a compressive force to the tube 310 and its contents and therefore, to urge the toothpaste disposed in the tube 310 toward the threaded neck 324 until the pressure within the tube 310 is sufficient to expel the quantity of toothpaste 326 from the tube 310 and to dispense the quantity of toothpaste 326 onto the toothbrush 328.

The exterior of the roller 316 preferably includes a coating of a sufficiently high coefficient of friction material such as rubber so that it "sticks" to the tube 310 and does not spin as it is rotated. However, even if it were to spin, the downward force applied to the roller 316 by the finger(s) 329 is sufficient to dispense the quantity of toothpaste 326.

As soon as force by the finger 329 is stopped, pressure within the tube 310 drops to nearly zero and no more toothpaste 326 is dispensed until the finger(s) 328 is again placed on the roller 316 and the cycle is again repeated. The toothpaste 326 includes a high-enough viscosity so that it will not drip absent an increase of pressure within the tube 310. This allows for almost instant dispensing of the quantity of toothpaste 326 when desired.

Of course, substances other than the toothpaste 326 can be dispensed in this manner when other tubes (not shown) are similarly suspended.

When the roller assembly 312 is disposed at the bottom of the tube 310, the tube 310 is discarded and the above-described procedure is repeated.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A tube holder adapted for use with a squeezable tube, comprising:

(a) a substantially planar base that is adapted for attachment to a flat surface and a substantially planar bottom member that extends away from a bottom of said base;

(b) a plurality of sidewalls extending out from said substantially planar base wherein a space intermediate a first and a second of said sidewalls form a compartment that is adapted to receive said squeezable tube therein; and (c) a moveable member disposed intermediate said first and said second sidewalls;

wherein said moveable member is adapted to be urged upward along a longitudinal length of said first and second sidewalls and down along a longitudinal length of said first and second sidewalls, and wherein said moveable member includes a longitudinal length and a first end and an opposite second end, and wherein said first sidewall includes a first slot and wherein said second sidewall includes a second slot, and wherein said first slot and said second slot form an opposite pair of slots, and wherein said first slot and said second slot face each other and are disposed in a spaced-apart parallel orientation with respect to each other, and wherein said first slot and said second slot each include a longitudinal slot length, and wherein said first slot and said second slot extend linearly along said longitudinal slot length, and wherein said first slot and said second slot do not include any curvature along said longitudinal slot length, and wherein said first slot and said second slot extend substantially along said longitudinal length of said first and second sidewalls, and wherein said first slot and said second slot are disposed in said first and second sidewalls a predetermined distance away from said base such that said first slot and said second slot are each disposed closer to a distal end of said first and second sidewalls than said first slot and said second slot are disposed away from a proximate end of said first and second sidewalls, and wherein said distal end is disposed maximally away from said base, and wherein said proximate end is disposed proximate said base, and wherein said first end of said moveable member is disposed in said first slot and said second end of said moveable member is disposed in said second slot, and wherein said moveable member is able to be urged along said longitudinal slot length, and wherein a space that is contained within said base, said first sidewall and said second sidewall, said bottom member, and said moveable member is sufficient to dispose said squeezable tube therein when said squeezable tube is disposed in an orientation wherein a longitudinal axis of said squeezable tube is in parallel alignment with said opposite pair of slots, and wherein an end of said squeezable tube is supported by said bottom member, and wherein when a force is applied to said moveable member sufficient to urge said moveable member along said longitudinal slot length into a desired position, said moveable member is retained at said desired position when said force is removed, and wherein said moveable member retains said squeezable tube in said space of said tube holder.

2. The tube holder of claim 1 wherein said moveable member includes means for varying said longitudinal length of said moveable member intermediate said first end and said second end thereof.

3. The tube holder of claim 2 wherein said means for varying said longitudinal length of said moveable member includes providing a plurality of accordion folds in said moveable member and wherein said plurality of accordion folds are adapted to be compressed to accommodate a shorter distance intermediate said first end and said second end of said moveable member and wherein said plurality of accordion folds are adapted to be expanded to accommodate a greater distance intermediate said first end and said second end of said moveable member, and wherein said first end of said moveable member is disposed in said first slot and said second end of said moveable member is disposed in said second slot to accommodate either a shorter distance or a longer distance between said first sidewall and said second sidewall.

4. The tube holder of claim 1 wherein at least one of said plurality of sidewalls is an interior sidewall, and wherein said interior sidewall is disposed in a parallel spaced apart relationship with respect to a first outer sidewall.

5. The tube holder of claim 4 wherein said interior sidewall includes means for varying a horizontal position of said interior sidewall wherein said interior sidewall is adapted to be moved closer to or further away from said first outer sidewall.

6. The tube holder of claim 5 including means for retaining said interior sidewall in a preferred horizontal position with respect to said first outer sidewall.

7. The tube holder of claim 6 wherein said means for retaining said interior sidewall includes means for cooperating with said base, said means for cooperating attached to said interior sidewall sufficient to retain said interior sidewall to said base in said preferred horizontal position.

8. The tube holder of claim 6 wherein said means for retaining said interior sidewall includes means for cooperating with said bottom member, said means for cooperating attached to said interior sidewall sufficient to retain said interior sidewall to said bottom member in said preferred horizontal position.

9. The tube holder of claim 4 including a second outer sidewall that is in a spaced apart parallel relationship with respect to said first outer sidewall and wherein said second outer sidewall is distally disposed with respect to said first outer sidewall.

10. The tube holder of claim 1 including a bottom strip that is disposed at a front of said bottom member and wherein said bottom strip extends above a plane of said bottom member and wherein said bottom strip extends intermediate a pair of said plurality of sidewalls.

11. The tube holder of claim 5 including a plurality of interior sidewalls and wherein at least two of said interior sidewalls includes means for varying a horizontal position of said at least two of said interior sidewalls wherein said at least two of said interior sidewalls are adapted to be moved closer to or further away from said first outer sidewall.

12. The tube holder of claim 1 wherein said compartment includes a plurality of compartments that are disposed in a side by side orientation to form a first row of compartments and including a second plurality of compartments that are disposed in a side by side orientation to form a second row of compartments and wherein said second row of compartments is disposed below said first row of compartments.

13. The tube holder of claim 1 including means for suspending a tube of toothpaste in an inverted position in said compartment.

14. The tube holder of claim 13 including means for applying a force to said tube of toothpaste sufficient to dispense a quantity of toothpaste from said tube while said force is applied to said tube and to not dispense any toothpaste from said tube when said force is not applied to said tube.

* * * * *